US005769302A

United States Patent [19]

Richert et al.

[11] Patent Number: 5,769,302

[45] Date of Patent: Jun. 23, 1998

[54] HORIZONTAL STRIP STORAGE UNIT

[75] Inventors: Withold Richert, Hückelhoven; Paul Zembol, deceased, late of Neuss, both of Germany, by Ursula Erika Zembol, heiress

[73] Assignee: SMS Schloemann-Siemag Aktiengesellschaft, Düsseldorf, Germany

[21] Appl. No.: 745,967

[22] Filed: Nov. 8, 1996

[30] Foreign Application Priority Data

Nov. 13, 1995 [DE] Germany ..... 195 42 184.1

[51] Int. Cl.[6] ..... B65H 20/24

[52] U.S. Cl. ..... 226/118.1; 226/189

[58] Field of Search ..... 226/119, 189, 226/199, 118.1, 118.2

[56] References Cited

U.S. PATENT DOCUMENTS

| | | | |
|---|---|---|---|
| 4,167,150 | 9/1979 | Davis et al. | 226/118 |
| 5,301,865 | 4/1994 | Klamma et al. | 226/118 |
| 5,533,327 | 7/1996 | Albert | 57/311 |

FOREIGN PATENT DOCUMENTS

| | | |
|---|---|---|
| 0110864 | 6/1984 | European Pat. Off. . |
| 0388708 | 9/1990 | European Pat. Off. . |
| 299103 | 10/1970 | Germany . |
| 1953169 | 5/1971 | Germany . |

*Primary Examiner*—William Stryjewski
*Attorney, Agent, or Firm*—Friedrich Kueffner

[57] ABSTRACT

A horizontal strip storage unit, particularly for sheet steel, includes a looping carriage which is movable on a frame at a variable distance relative to a stationary strip guide roller. The looping carriage has at least one guide roller for a strip storage loop whose length is variable. Several support carriages with support rollers are arranged between the strip guide roller and the looping carriage. A flexible endless drive element guided around guide rollers is connected to the looping carriage. The drive element is guided so as to interact with a drive wheel of each support carriage, wherein the travel mechanism of each support carriage relative to the travel path of the looping carriage is derived from the flexible drive element. A second flexible drive element is tensioned along the frame in the area of the path of movement of the support carriages, wherein the second flexible drive element is guided over a lower drive wheel of each support carriage so as to interact with the drive element, and wherein the first drive wheel of each support carriage interacting with the first flexible drive element is kinematically connected through a gear unit to the second drive wheel.

8 Claims, 5 Drawing Sheets

25
19
1b
15
1c
16
20
21
24
23
6
6
7
7
34
35
35
34
1d
17
1a
18

HORIZONTAL STRIP STORAGE UNIT

BACKGROUND OF THE INVENTION

1. Field of the Invention

The present invention relates to a horizontal strip storage unit, particularly for sheet steel. The strip storage unit includes a looping carriage which is movable on a frame at a variable distance relative to a stationary strip guide roller. The looping carriage has at least one guide roller for a strip storage loop whose length is variable. Several support carriages with support rollers are arranged between the strip guide roller and the looping carriage. A flexible endless drive element guided around guide rollers is connected to the looping carriage. The drive element is guided so as to interact with a drive wheel of each support carriage, wherein the travel mechanism of each support carriage relative to the travel path of the looping carriage is derived from the flexible drive element.

2. Description of the Related Art

As is well known in the art, strip storage units are required in order to be able to operate roll stands in rolling mills continuously even when strip material from individual coils, which must be connected to each other before being introduced into the roll stand, are to be supplied endlessly and to be rolled by the rolling mill or roll stand. In order to prevent a temporary deceleration of the rolling speed or even a stoppage of the roll stands during this operation, a strip storage unit, for example, in the form of a loop storage unit or a looper, must be provided whose capacity is selected such that the strip can be continuously supplied to the roll stand or rolling mill even when the individual coils must be prepared and welded to each other.

The same considerations apply to other plant components which process metal strip, for example, pickling plants or annealing furnaces, which are operated continuously and in which it is necessary to compensate for different strip travel speeds of the incoming strip. Depending on the available space, looping towers, looping pits or horizontally extending strip storage units, frequently referred to as loopers, are used.

Horizontal strip storage units generally are characterized in that they have a looping carriage movably held with restoring force against the tension of the strip and a plurality of support carriages with support rollers arranged between the looping carriage and the guide roller, wherein the support carriages are also mounted so as to be movable. The restoring force is produced through ropes by a rope winch driven by a constant-speed drive.

DE-OS 1 953 169 discloses a horizontal strip storage unit for strip processing plants with support rollers arranged between looping carriage and inlet and outlet rollers, wherein the support rollers are mounted in one or more so-called trailers which are movable in horizontal direction. A driven rope drum for tensioning an assigned connecting rope is arranged on the trailers between the looping carriage and each next closest trailer. An endless chain with drivers for the individual trailers is fastened to the looping carriage.

Since, in this arrangement, the looping carriage pushes the trailers when the looping carriage is moved in order to shorten the storage loop, the restoring force acting through the rope drum drives merely has the purpose of keeping the connecting ropes tensioned, so that the respectively following trailers are moved by the looping carriage only when the rope lengths between the looping carriage and the respectively following trailer are used up.

This configuration is not capable of ensuring a jolt-free operation of the trailer carriages and, moreover, the configuration of each trailer with a driven rope winch is technically very complicated because it is necessary to provide for each trailer a separate torque motor with current feed-in through a contact line or a cable garland. The contact line is extremely disadvantageous because it constitutes a danger source and a cable garland with its required guide elements significantly limits the accessibility to the strip storage unit. Moreover, this known configuration including corresponding controls is very expensive.

EP-0 110 864 B1 discloses a horizontal strip storage unit which also includes a movable looping carriage to which are coupled individual support carriages by means of flexible tension members which can be pulled out against a restoring force. These tension members are to be elastically extensible at least over portions thereof and are constructed, for example, as rubber ropes or the like and are guided around guide rollers so as to form loops. This configuration has the purpose of ensuring a jolt-free drive of the support carriages from the looping carriage while maintaining a uniform distance between the individual support carriages.

This configuration has the disadvantage that the flexible or elastic rubber ropes age relatively quickly and become brittle and, thus, can wear quickly in an uncontrolled manner or can rupture, particularly when radiation heat acts on the ropes. Also, rubber ropes can be easily damaged in the dangerous surroundings of a rolling mill, so that there is the danger that the rubber ropes tear or rupture quickly.

EP 0 388 708 B1 discloses a horizontal strip storage unit with a movable looping carriage to which are coupled individual support carriages by means of a rope, a cam drum and a torque motor. Each of the cam drums produces the respective distance between the support carriages, wherein a uniform torque of the motor maintains the rope connections under tension. As is the case in the aforementioned DE-OS 1 953 169, this storage unit has the disadvantage that a separate torque motor must be arranged for each support carriage and the current must be fed in also through a contact line or a cable garland. Accordingly, the configuration according to EP 0 388 708 B1 has the same disadvantages as those described above.

AT-PS 299 103 discloses a horizontal strip storage unit for sheet steel with a looping carriage which can be moved and can preferably be driven with a constant drive torque so as to increase the size of the loop, and with several support carriages which are movable along guide rails. An endless rope guided around guide rollers is connected to the looping carriage and the support carriages. Through pick-up rollers and with the intermediate arrangement of step-down gear units, the drive for the support carriages is derived from this rope in such a way that when the looping carriage is moved, the support carriages have equal distances between each other.

During extended operation of the strip storage unit, it may happen that a slip occurs between the rope used as a drive element and the pick-up rollers at the support carriages. This slip produces the result that the distances between the support carriages change and are no longer equal to each other. This may have the result that when the distances between the individual support carriages are not equal, the support carriages bump into each other or against stop members or are contacted by the looping carriage in a jolt-like manner. In order to prevent this, each support carriage is provided with a slip clutch which acts in both directions and is equipped with a lever linkage. Disadvantages of this configuration are the required kinematic expenditure as well as frequent maintenance required because the configuration is susceptible to trouble, however, this configuration can still not guarantee a truly jolt-free operation.

SUMMARY OF THE INVENTION

Therefore, it is the primary object of the present invention to provide a horizontal strip storage unit of the above-described type in which the disadvantages and difficulties discussed above are eliminated. In particular, the connections between the support carriages and the looping carriage should be constructed in a simple manner in order to provide a trouble-free and preferably maintenance-free operation. Also, the connections between the support carriages and the looping carriage should make it possible that, when the looping carriage is moved in order to change the loop, the distances between the support carriages change without jolts and remain equal, so that the requirements for an optimum guidance of the strip on the support rollers of the support carriages are met.

In accordance with the present invention, a strip storage unit of the above-described type includes a second flexible drive element tensioned along the frame in the area of the path of movement of the support carriages, wherein the second flexible drive element is guided over a lower drive wheel of each support carriage so as to interact with the drive element, and wherein the first drive wheel of each support carriage interacting with the first flexible drive element is kinematically connected through a gear unit to the second drive wheel.

The lower drive element replaces in an advantageous manner the motor-driven rope winches at the support carriages which are frequently used in the prior art and the lower drive element ensures that uniform distances are automatically formed between the support carriages when the looping carriage or the storage loops are moved in and out.

This is achieved in an uncomplicated manner and with significant advantage as a result of the fact that, when the looping carriage is moved together with the upper drive element connected to the looping carriage, the upper drive wheel surrounded by the upper drive element of each support carriage is driven so as to rotate. Because of the connection with a gear unit between the upper drive wheel and the lower drive wheel, the lower drive wheel is driven proportionally in accordance with the step-down ratio of the gear unit. However, since the lower drive element is mounted so as to be stationary, the lower drive wheel of the support carriages which are in positive engagement with the lower drive element are moved so as to carry out a relative travel movement in accordance with the ratio of the travel distance of the looping carriage to the travel distance of the support carriages as a result of the fact that the lower drive wheel rolls on the lower drive element.

The gear ratios of the individual support carriages are selected in such a way that the respective distance between the looping carriage and the stationary strip guide roller is divided into always equal distances.

In accordance with a further development of the invention, the flexible drive elements are V-belts, gear chains, roller chains, link chains or toothed belts. In accordance with an advantageous feature, the drive elements are toothed belts and the drive wheels interacting with the drive elements are pinions. As a result, a secure, low-noise and slip-free operation of the strip storage unit is achieved.

Additional advantages of the strip storage unit according to the present invention are to be seen in the fact that, during filling of the storage unit as well as during emptying of the storage unit, the sheet steel is supported by the support rollers of the support carriages with equal distances between the support carriages, that no jolt-like loads are transmitted to the support carriages during the displacement of the looping carriage, and that the use of toothed belts and the gear unit produces a simple, inexpensive and reliable system.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figure 1:
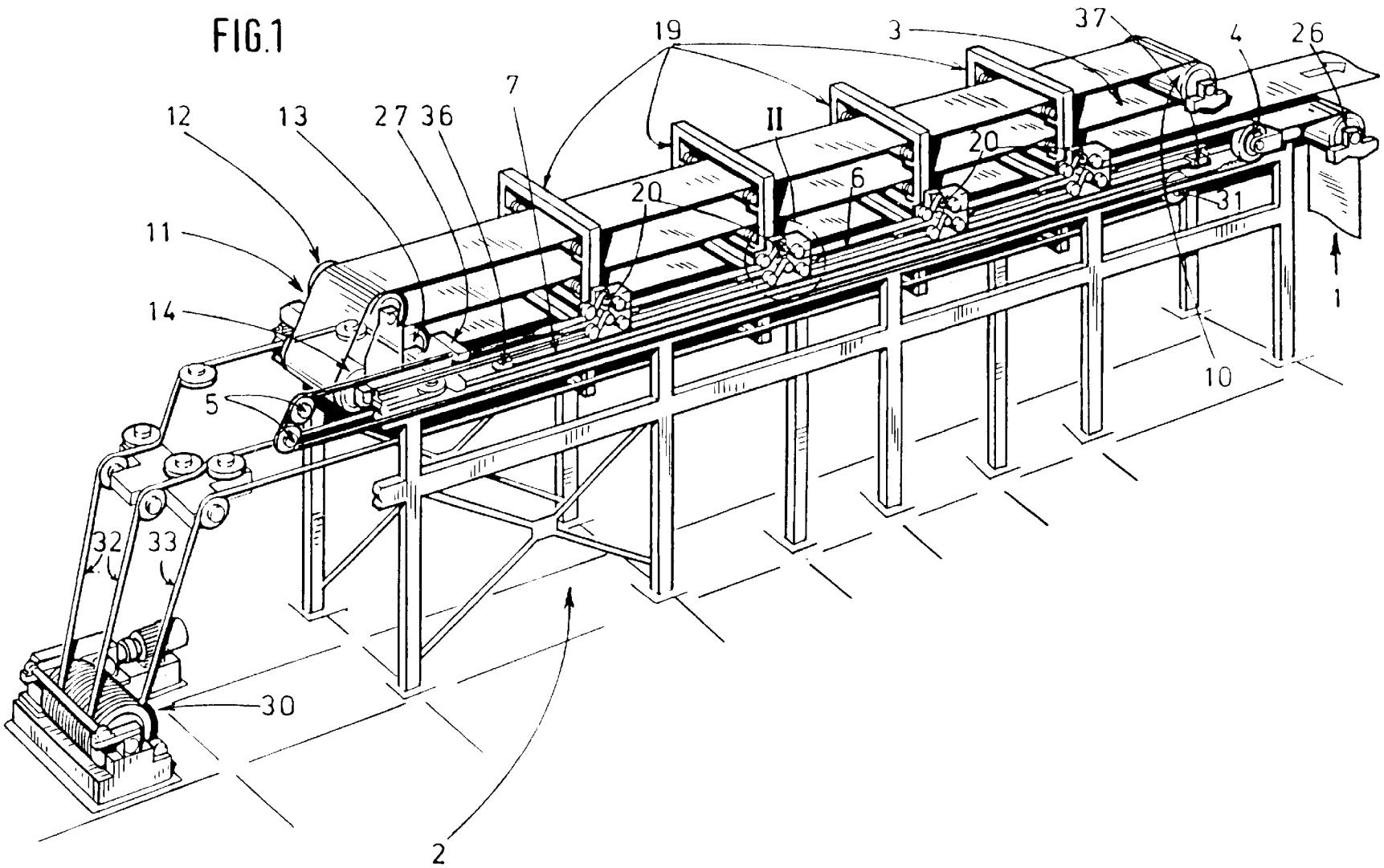
FIG. 1 is perspective view of a horizontal strip storage unit according to the present invention.
Figure 3:
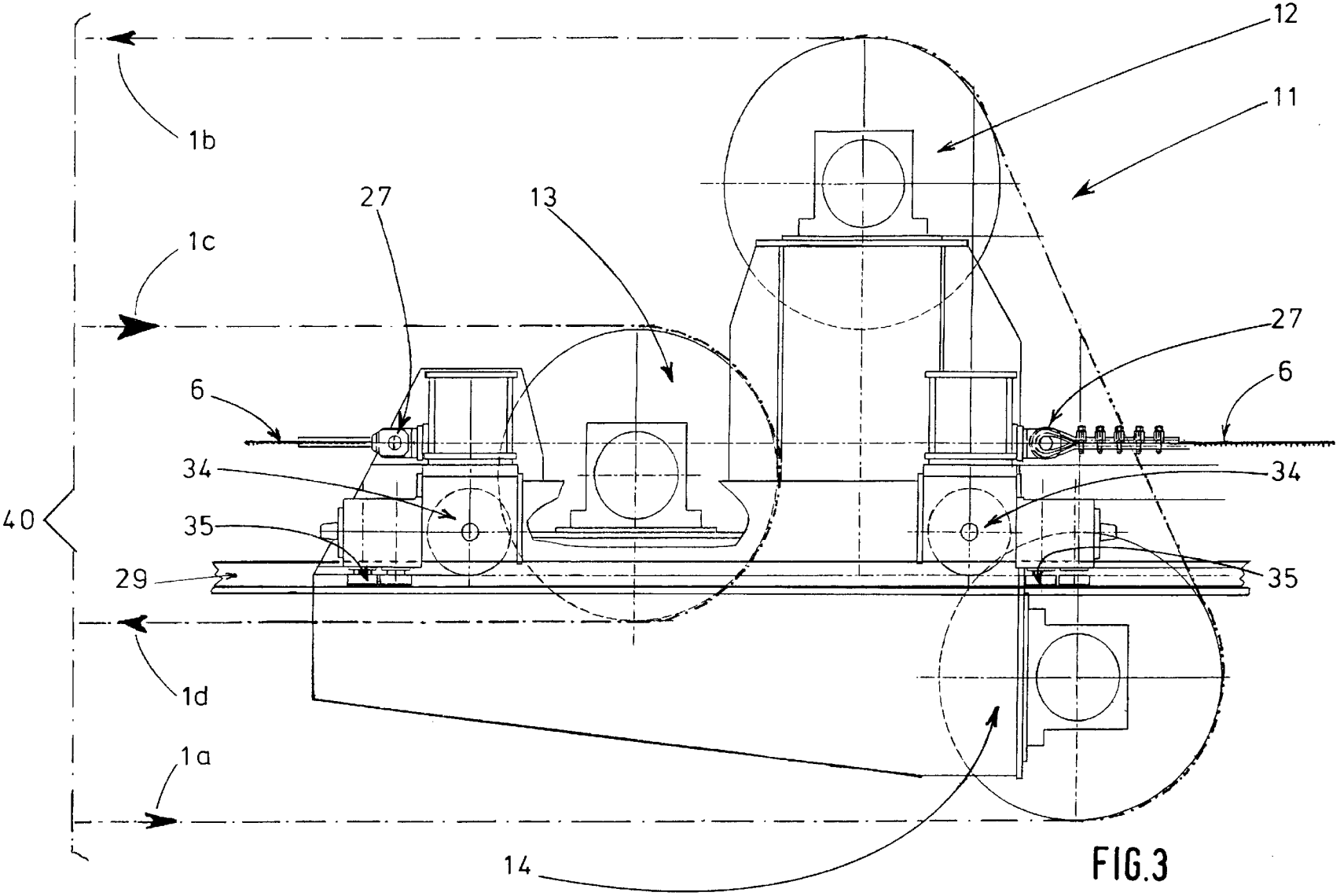
FIG. 3 is a schematic side view, on an even larger scale, of a looping carriage.

FIG. 1 of the drawing shows a horizontal strip storage unit for sheet steel or strip 1 which includes a looping carriage 11. The looping carriage 11 is movable at a variable distance relative to a stationary strip guide roller 10. The looping carriage 11 has guide rollers 12–14 for at least one length-adjustable storage loop 3 of the strip 1 or a double loop 40 as shown in FIG. 3.

Figure 4:
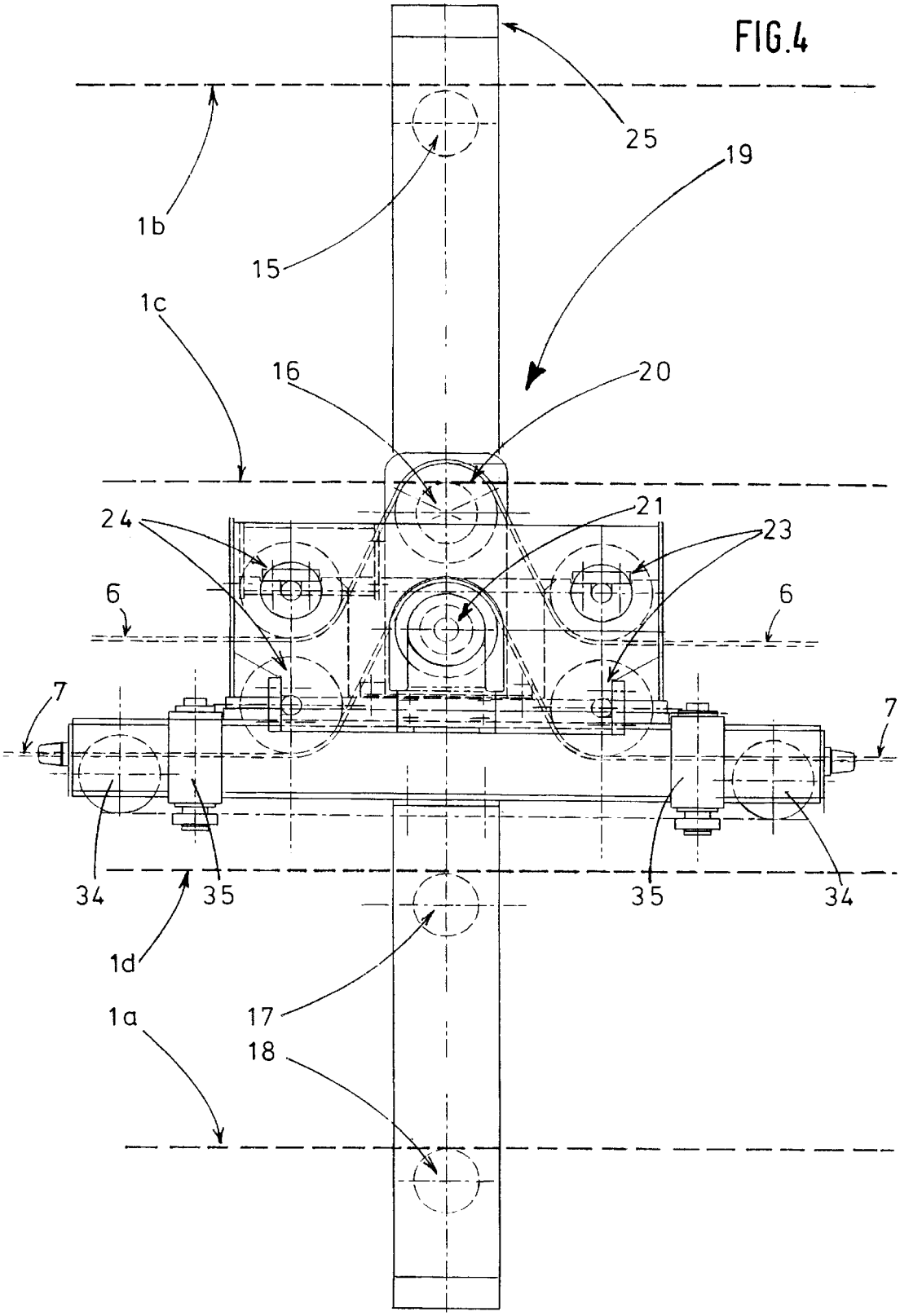
FIG. 4 is a schematic side view of a support carriage.
Figure 5:
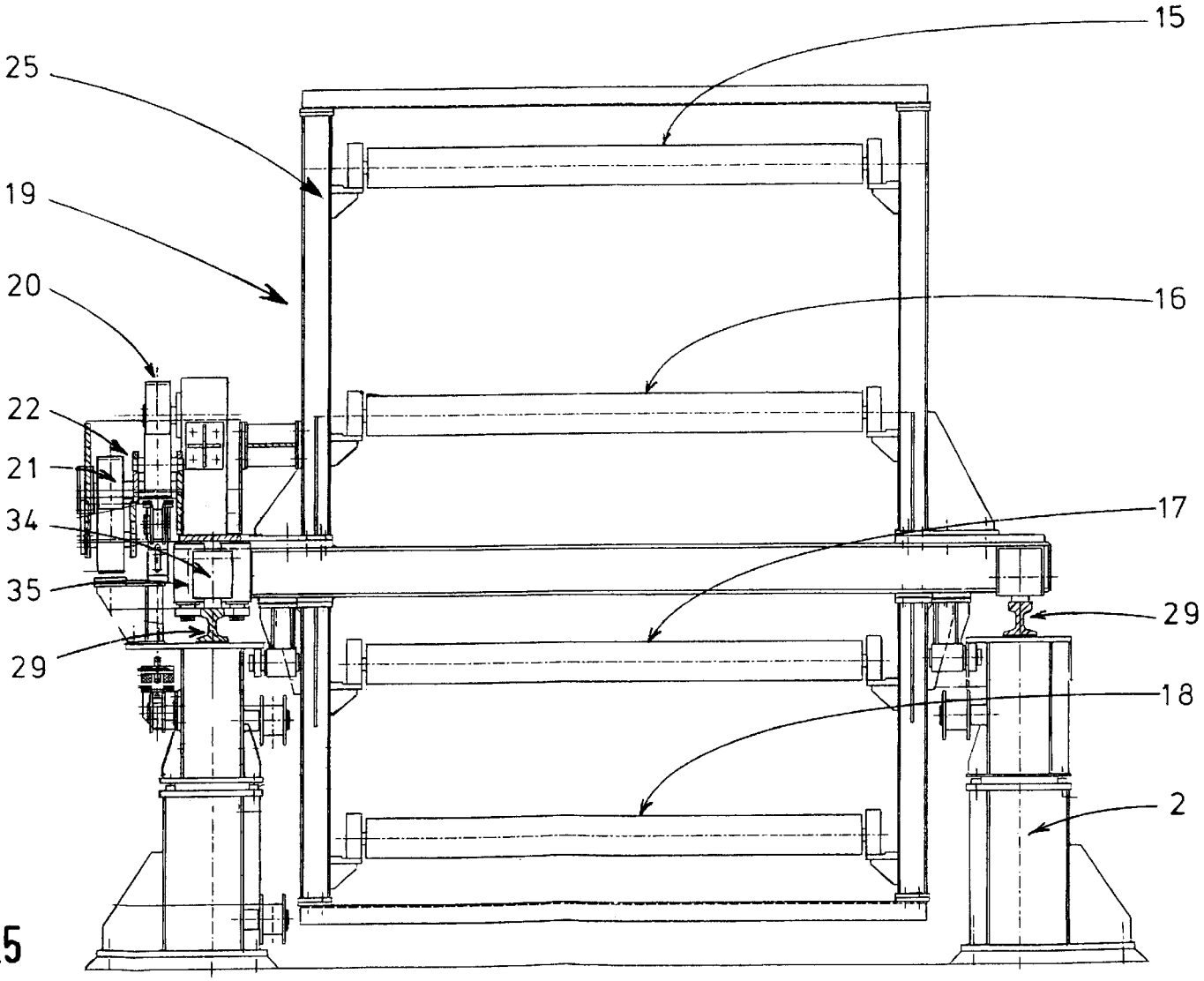
FIG. 5 is a schematic front view of a support carriage.

The strip storage unit further includes support carriages 19 provided with support rollers 15–18 for the strip 1, as shown in FIGS. 4 and 5. A flexible drive element 6 guided endlessly around guide rollers 4, 5 and connected to the looping carriage 11 is guided on a drive wheel 20 of each support carriage 19, wherein the travel drive of each support carriage 19 is derived from the flexible drive element 6. Each support carriage 19 has at least two or more support roller 15–18, for example, four, six or ten guide rollers.

The incoming strip 1 is guided over a guide roller 26 into the horizontal strip storage unit. By means of a rope winch 30 and through ropes 32 and corresponding guide rollers, the looping carriage 11 is held in the illustrated pulled-out position with a restoring force against the tensile force of the loop 3, or the double loop 40 shown in FIG. 3. The rope 3 is guided about a guide roller 31 at the end of the frame 2 opposite the looping carriage 11 and the rope 33 has the purpose of returning the looping carriage 11 into the shortest position in the unloaded state of the loop storage unit. The flexible drive element 6 is secured to the looping carriage 11 through a stop member 27 arranged at the looping carriage 11.

Figure 2:
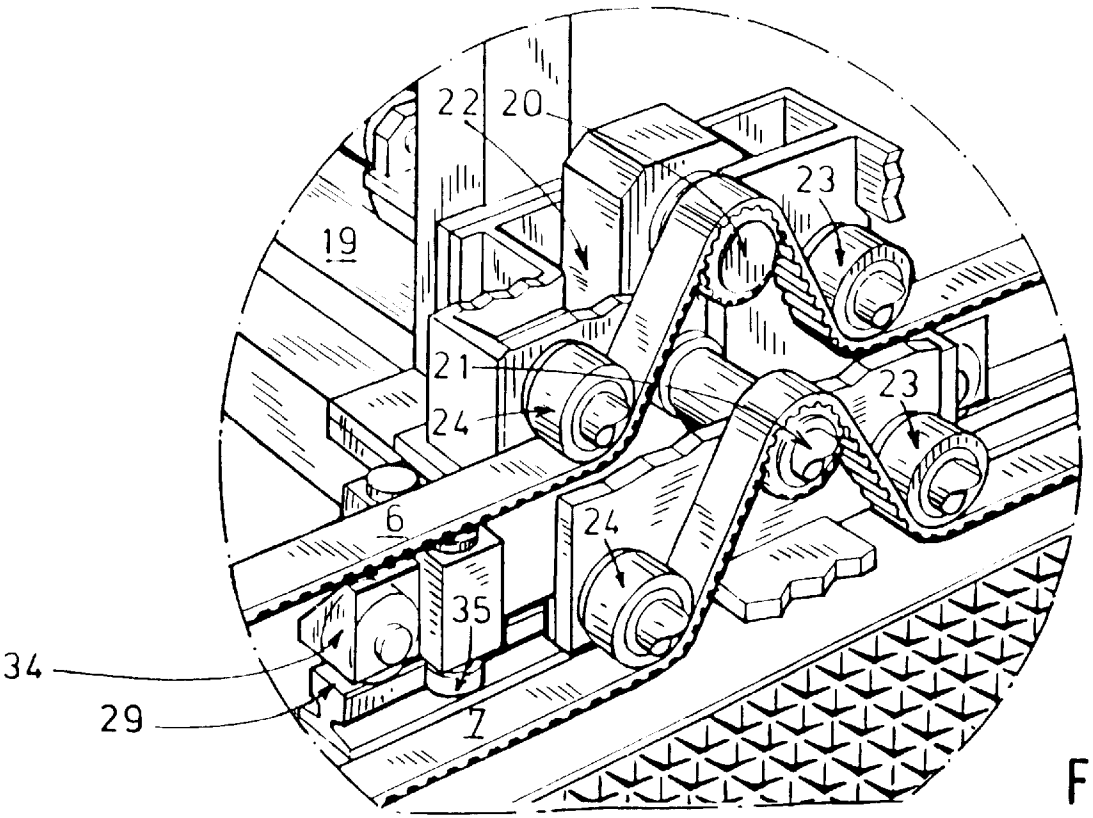
FIG. 2 is a perspective view, on a larger scale, of the drive side of a support carriage of the strip storage unit.

As can be seen in FIGS. 1 and 2 of the drawing, the drive element 6 is guided at each support carriage 19 around a drive wheel 20 arranged on the respective support carriage 19. Guide rollers 23, 24 ensure a sufficiently large angle of contact around the guide wheel 20 of approximately 120°. FIG. 2 shows in detail that the support carriage 19 can be moved by means of wheels 34 on rails 29 placed on the frame 2 and that the support carriage 19 is securely guided by lateral guide wheels 35.

As further shown in FIGS. 1 and 2, a second flexible drive element 7 is tensioned along the frame 2 in the area of the travel path of the support carriages 19. The second flexible drive element 7 is guided over a lower drive wheel 21 of each support carriage 19, wherein the drive wheel 21 interacts with the drive element 7. The drive element 7 is secured to the frame 2 at fastening elements 36, 37, respectively.

In accordance with the invention, the first drive wheel 20 is kinematically connected to the second drive wheel 21 through a gear unit 22, as shown in FIG. 5.

The flexible drive elements 6, 7 may essentially be V-belts, gear chains, roller chains, link chains or toothed belts. Taking into consideration the requirement for a slip-free state of operation, the invention preferably provides that the flexible drive elements 6, 7 are toothed belts and the drive wheels 20, 21 interacting with the drive elements are pinions. The guide rollers 23, 24 ensure that the angles of contact of the drive elements 6, 7 around the drive wheels 20, 21 are sufficiently large.

A significant feature of the present invention resides in the fact that the individual gear ratios between the drive wheels 20, 21 of each support carriage 19 are selected in such a way that the distance between the looping carriage 11 and the stationary strip guide roller 10 is divided into always equal distances formed by the support carriages 19, as shown in FIG. 1 in the pulled-out state of the strip storage unit. This ensures that the various strip portions 1*a*–1*d*, shown in FIGS. 3 and 4, are guided in an optimum manner and that a jolt-free movement of the support carriages 19 is ensured at the same time.

FIG. 3 is a side view of a looping carriage 11 with strip guide rollers 12–14. In accordance with FIGS. 2 and 3, the looping carriage 11 is also movable on the rails 29 of the frame 2 and, in the manner already described above, a constant pulling force of the winch 30, shown in FIG. 1, by means of the ropes 32 applies a constant restoring force against the pulling action of the strip portions 1*a*–1*d*, so that the looping carriage 11 is held on the frame 2 along its travel path in accordance with the length of the double loop 40. In order to prevent a tilting moment of the looping carriage 11 which is movable on wheels 34 along the rails 29, guide wheels 35 may be constructed in such a way that they can engage behind the rail heads as necessary. For stopping and tensioning the drive element 6 traveling with the looping carriage 11, stop members 27 are provided on both sides of the drive element 6.

FIG. 4 shows a support carriage 19 with support rollers 15–18 for the strip portions 1*a*–1*d*. The support rollers are arranged at equal distances between each other in a support frame 25. The support carriage 19 travels on the wheels 34 and is securely guided by guide wheels 35 so as to be protected against tilting. The drive elements 6, 7 are in a continuous slip-free engagement with the drive wheels 20, 21 by means of guide rollers 23, 24 which produce an angle of contact of approximately 120° between the drive elements and the drive wheels.

FIG. 5 is a front view of a support carriage 19 and shows the arrangement of the guide rollers 15–18 with their bearings in the frame 25. FIG. 5 further shows the arrangement of rails 29 on the frame 2. The support carriage 19 travels with the wheels 34 on the rails 29 while being securely guided by the guide wheels 35. FIG. 5 further shows the arrangement of the drive wheels 20, 21 laterally next to the frame 25 and, in a sectional view, the gear wheels of the step-down gear unit 22.

While specific embodiments of the invention have been shown and described in detail to illustrate the inventive principles, it will be understood that the invention may be embodied otherwise without departing from such principles.

We claim:

1. A horizontal strip storage unit comprising a frame, a stationary strip guide roller, and a looping carriage movably mounted on a frame at a variable distance relative to the stationary strip guide roller, the looping carriage having at least one guide roller for a strip storage loop of variable length, a plurality of support carriages with support rollers being mounted so as to be movable along a path of movement on the frame between the strip guide roller and the looping carriage, a first flexible endless drive element guided around guide rollers being connected to the looping carriage, the first flexible drive element being guided so as to be in engagement with a first drive wheel of each support carriage for driving each support carriage, further comprising a second flexible drive element tensioned along the frame within the path of movement of the support carriages, the second flexible drive element being guided so as to be in engagement with a second drive wheel of each support carriage, each support carriage comprising a gear unit for kinematically connecting the first drive wheel to the second drive wheel.

2. The strip storage unit according to claim 1, wherein the first and second drive elements are toothed belts and the first and second drive wheels are pinions.

3. The strip storage unit according to claim 1, wherein the gear unit between the first and second drive wheels of each support carriage has a gear ratio selected such that a distance between the looping carriage and the stationary strip guide roller is divided into equal spacings between the support carriages.

4. The strip storage unit according to claim 1, comprising a rope winch for holding the looping carriage with a restoring force against a tension of the strip.

5. The strip storage unit according to claim 1, wherein the looping carriage comprises three guide rollers for forming a double storage loop.

6. The strip storage unit according to claim 1, wherein each support carriage has four support rollers arranged at distances between each other.

7. The strip storage unit according to claim 1, wherein the first and second flexible drive elements are slip-free drive elements.

8. The strip storage unit according to claim 7, wherein the slip-free drive elements are one of a gear chain, a roller chain, a link chain and a toothed belt.

* * * * *